United States Patent [19]

LaRue

[11] Patent Number: 4,569,212

[45] Date of Patent: Feb. 11, 1986

[54] KNIT YARN PACKAGE

[75] Inventor: Robert A. LaRue, Fall River, Mass.

[73] Assignee: Globe Manufacturing Co., Fall River, Mass.

[21] Appl. No.: 736,774

[22] Filed: May 22, 1985

[51] Int. Cl.[4] ..... D04B 7/04

[52] U.S. Cl. ..... 66/196

[58] Field of Search ..... 66/196, 195, 252; 28/218

[56] References Cited

U.S. PATENT DOCUMENTS

| | | | |
|---|---|---|---|
| 3,466,718 | 9/1969 | Adamson | 28/72.16 |
| 3,540,492 | 11/1970 | Houwing | 139/116 |
| 3,542,084 | 11/1970 | Rupprecht et al. | 139/116 |
| 3,827,261 | 8/1974 | Rupprecht | 66/195 |
| 4,411,142 | 10/1983 | Regenstein | 66/196 |

*Primary Examiner*—Ronald Feldbaum

*Attorney, Agent, or Firm*—Cushman, Darby & Cushman

[57] ABSTRACT

Improved elastic yarn package includes a plurality of individual yarn strands of highly elastic material, the fabric being formed with a first and second face and which is warp knitted in the form of an elongated tape from which a number of yarn strands can be unravelled for feeding to a fabric manufacturing device; the knit pattern for the individual strands permits unravelling as well as splitting of the web and does not cause the fabric to curl or twist on itself by using a knitting pattern for the individual strands where the individual yarn strands do not cross wales after forming a loop but only cross to an adjacent wale after being formed into two succeeding loops in adjacent courses.

10 Claims, 3 Drawing Figures

KNIT YARN PACKAGE

BACKGROUND AND SUMMARY OF THE INVENTION

The present invention relates to a knitted package of highly elastic yarn from one end of which individual yarn strands can be unravelled for feeding to a textile machine such as a knitting machine where a plurality of yarn ends are simultaneously utilized.

In U.S. Pat. No. 3,827,261, assigned to the same Assignee as the present application, there is disclosed an elastic knit yarn package in the form of a flat unravellable web or tape which is produced on a two needle bar warp knitting machine. The yarn package is characterized by the ease with which a number of yarn strands of the package can be unravelled simultaneously and fed with a minimum of entanglements to a textile machine for incorporation into a textile fabric. In addition, the fabric can easily be split to form a package or packages of a lesser number of ends.

In U.S. Pat. No. 4,411,142, a similar yarn package is disclosed which is said to be readily splitable into narrower tapes thus reducing waste when fewer ends are required than are provided by a given yarn package. In the stitch pattern, the underlaps do not cross each other or run in opposite directions between the wales of the fabric.

It has been found that the use of the prior art packages with highly elastic yarns of relatively high denier can result in undesirably low feeding speeds which can cause significant losses over a period of time with modern high speed textile fabric forming machines. That is to say, in view of the investment in such machines, it is often unacceptable to textile manufacturers that a specific yarn package can only be unravelled at an unacceptably slow speed that does not permit them to take full advantage of the increased production capacity of their fabric forming machines.

The present invention overcomes the foregoing difficulty particularly with high denier, highly elastic yarn such as spandex, by providing a knit pattern for a ravellable web or yarn package which will permit not only splitting of the tape but also unravelling at increased speeds with such high denier filaments without entanglements between adjacent yarns of the package. In one embodiment, a double faced warp knitted elongated fabric is provided where each yarn is knitted in two successive loops in one wale in successive courses followed by a crossing of the yarn to an adjacent wale and a repeating of the successive two loop pattern. For each yarn, the loops will alternate between the front and back face of the fabric.

With this stitch pattern, a substantially more manageable yarn package for highly elastic yarns of any denier will be obtained as well as a yarn package which can be easily fabricated at higher production speeds on the conventional double needle bar flat bed warp knitting machines.

The foregoing and other advantages of the present invention will become apparent as consideration is given to the following detailed description taken in conjunction with the accompanying drawings, in which:

DETAILED DESCRIPTION OF THE INVENTION

Figure 1:
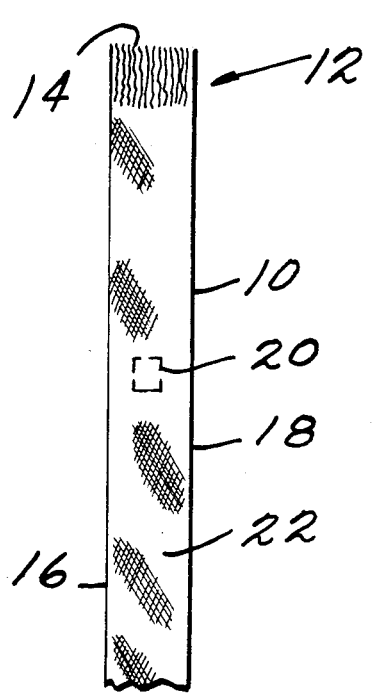
FIG. 1 is a plan view of a portion of a knit yarn package of the present invention.

Referring now to the drawings, there is shown in FIG. 1 a flat fabric 10 which at one end 12 has a plurality of unknitted yarn ends 14 extending therefrom. The fabric 10 may be knitted in the form of a strip or tape on a warp knitting machine such as a Raschel machine having two needle bars for constructing a double knit fabric. As described in the aforementioned U.S. Pat. No. 3,827,261, the double knit structure of the fabric 10 will enable the fabric to remain stable by reducing curl or roll inwardly towards the center of the fabric from the opposite edges 16 and 18. This will greatly facilitate handling of the fabric 10 as a package from which the individual yarn strands 14 may be uniformly fed for subsequent textile forming operations.

Figure 2:
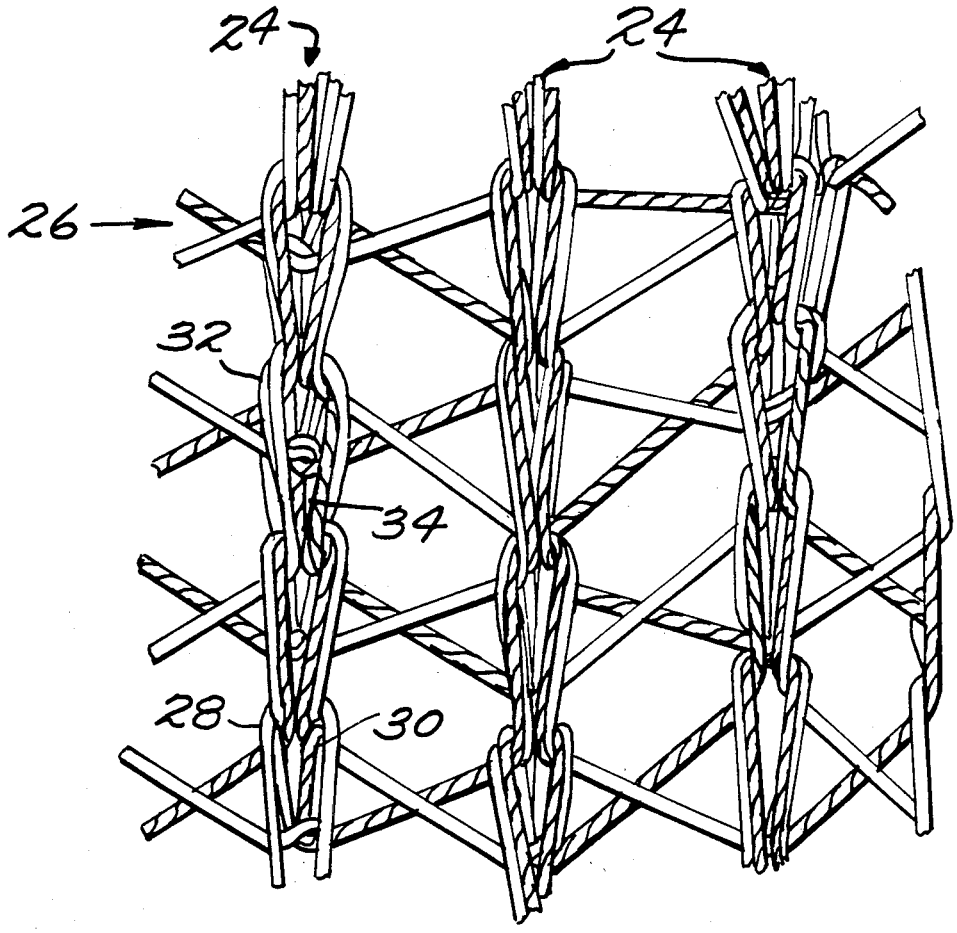
FIG. 2 is a greatly enlarged view of a portion of the package that is enclosed within the dotted line rectangle in FIG. 1.

A section 20 of the fabric 10 is shown in greatly enlarged detail in FIG. 2. It will be understood that the fabric illustrated in FIG. 2 is expanded as by stretching in the width and length direction to more clearly show the knit structure of the fabric 10. The fabric, according to the present invention, is preferably constructed with single ends of highly elastic yarn such as spandex or that sold under the trademark Glospan. The knit pattern, as described below, can be used with any available denier and is particularly useful with yarns of a thousand denier and above, whereas previously used knitting patterns sometimes exhibited problems at the opposite extremes of the available denier range. Denier of 1120, 1680 and at least 2000 are used.

As shown in FIG. 2, the knit yarn package in the form of fabric 10 is knitted to have two faces, one of which is shown at 22 in FIG. 1. Each face is formed with a number of wales 24 extending parallel to the length dimension of the fabric 10. The courses 26, of course, extend generally transverse to the wales 24. The wales 24 are defined by the yarn loops such as those at 28, 30, 32 and 34. It will be understood, that in FIG. 2, while all the yarns are identical, alternate yarns are shown with hatching to facilitate visual distinction between the yarns in each wale. As shown, at the intersection of each course and wale, on one face of the fabric 10, there will lie two loops of two separate yarn ends. On the opposite face, another two loops of different yarn ends will be disposed with the stitches being open to facilitate unravelling of the web.

One manner in which the web may be used to effect unravelling and feeding to a textile operation is disclosed in U.S. Pat. No. 3,542,084 the disclosure of which is incorporated by reference. Specifically, a pair of feed rolls are disposed to define a nip through which the knit yarn package is passed with the end of the yarn package held in a spring clamp. Immediately downstream of the resilient clamp, the unknitted ends 14 may be separated and fed either directly or through guide members to the textile machine.

Figure 3:
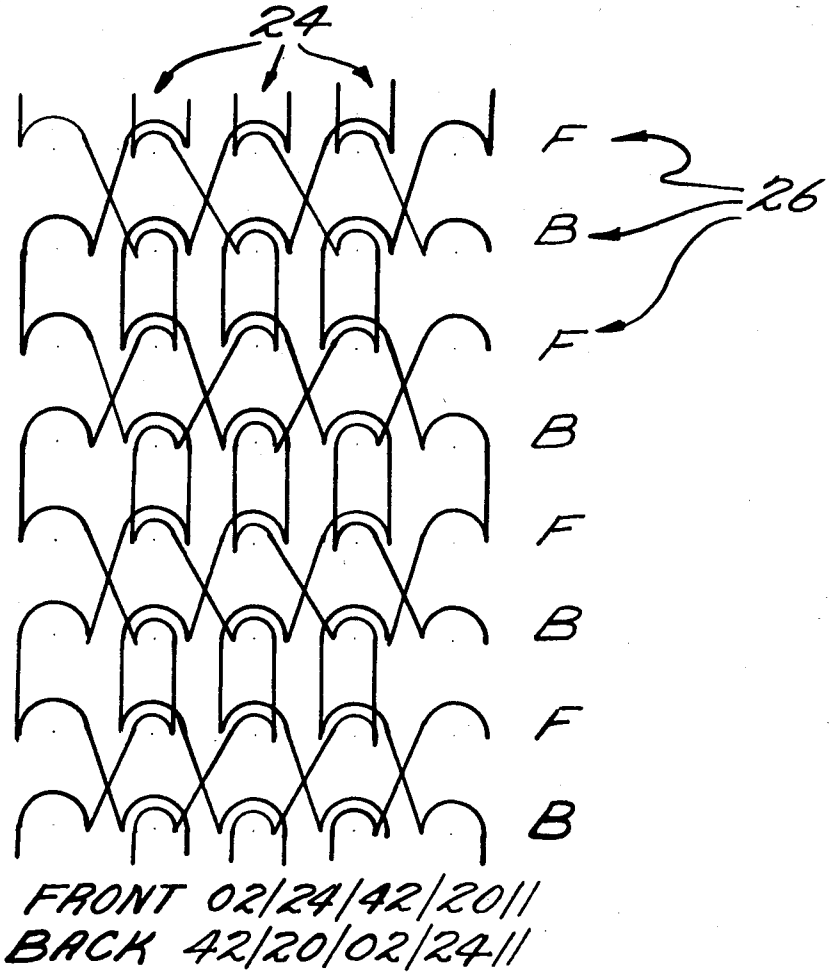
FIG. 3 is a lap diagram of the knitted yarn package of the present invention.

With reference now to the lap diagram of FIG. 3, the "F" and "B" located on the right hand column represent the front needle bar and the back needle bar of a two needle bar warp knitting machine. The conventional lap notation is found in B. F. Paling, "Warp Knitting Technology", Columbine Press, Great Britain (1970, page 216), as is used in the present application.

In the present invention, every yarn of the fabric follows a two wale pillar pattern where the yarn forms two loops in successive courses in one wale and then transfers to an adjacent wale to form again, two successive loops in two successive courses before repeating the pattern in the first wale in the wale direction. The loops alternate between the front and back as indicated in FIG. 3. Preferably, the yarns are all of the same denier although variations in denier could be tolerated in the knit construction.

While in one embodiment, unknitted yarn ends extend from one end of the package from which unravelling would normally take place, unknitted portions can also be provided at both ends of a package, if desired. In FIG. 3, the wales corresponding to the wales 24 of FIG. 2 are indicated and two of the courses 26 are also indicated.

With the knit package of the present invention, it will be seen that for each needle bar, the stitch pattern will have a cross over from one wale to an adjacent wale after a pair of courses have been formed. It has been found with this arrangement, a very stable fabric will be achieved yet one which can be easily split into narrower tapes should demand so require.

It will be appreciated by those skilled in this art that elastic yarns other than spandex may be employed although spandex filaments, whether covered or uncovered, can be processed in the present invention.

What is claimed is:

1. A yarn package of highly elastic yarns comprising a flat fabric having two faces each composed of generally parallel extending wales and courses and knitted with a plurality of individual yarn strands, each yarn strand being formed into a pattern of loops, said pattern including, for each yarn strand, two successive loops in one wale followed by a cross over to an adjacent wale where two successive loops are formed before the pattern is repeated, said loops alternating from one face to the other face of said fabric, with said pattern repeating along the wale direction of said fabric.

2. The fabric of claim 1 wherein there are no more than two loops on one face of said fabric at an intersection of a course and wale.

3. The yarn package as claimed in claim 1, wherein said yarns are synthetic fibers.

4. The yarn package as claimed in claim 1, wherein said fabric is knitted in the form of an elongated web having a length dimension that is substantially greater than its width dimension.

5. The yarn package as claimed in claim 1, wherein said yarns are spandex yarns.

6. The yarn package as claimed in claim 1, wherein said fabric is a warp knit fabric.

7. The yarn package as claimed in claim 1, wherein said yarns are all of substantially the same denier.

8. The yarn package as claimed in claim 1, wherein the denier of said yarns is at least 1120.

9. The yarn package as claimed in claim 6, wherein the denier of said yarns is at least 1680.

10. The yarn package as claimed in claim 1, wherein the denier of said yarns is at least 2000.

* * * * *